US006213814B1

(12) United States Patent
Kuo et al.

(10) Patent No.: US 6,213,814 B1
(45) Date of Patent: Apr. 10, 2001

(54) CABLE CONNECTOR

(75) Inventors: Peter Kuo, Chung-Ho; Ji-Cheng Lee, Taipei, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/651,343

(22) Filed: Aug. 29, 2000

Related U.S. Application Data

(63) Continuation of application No. 09/290,769, filed on Apr. 13, 1999, now Pat. No. 6,109,969.

(30) Foreign Application Priority Data

Apr. 13, 1998 (TW) ..... 87205642

(51) Int. Cl.[7] ..... H01R 13/648

(52) U.S. Cl. ..... 439/607; 439/939

(58) Field of Search ..... 439/607, 609, 439/610, 901, 906, 937

(56) References Cited

U.S. PATENT DOCUMENTS 5,195,909 * 3/1993 Huss, Jr. et al. ..... 439/465

* cited by examiner

*Primary Examiner*—Brian Sircus
*Assistant Examiner*—Javaid Nasri
(74) *Attorney, Agent, or Firm*—Wei Te Chung

(57) ABSTRACT

An EMI shield for use with a cable connector comprises an extension extending from a front portion of the shield. A mating face orthogonal to a horizontal direction of the shield is formed at an end of the extension. The mating face forms a plurality of contacting buds thereon.

1 Claim, 3 Drawing Sheets

CABLE CONNECTOR

This is a continuation of application Ser. No. 09/290,769 filed Apr. 13, 1999, now U.S. Pat. No. 6,109,969.

FIELD OF THE INVENTOR

The present invention relates to a cable connector, and more particularly to a cable connector having an EMI shield for facilitating efficient signal transmission therethrough.

DESCRIPTION OF PRIOR ART

Cable connectors are assembled to ends of a cable which facilitates signal transmission between two computer systems. For example, a notebook computer requires a cable to electrically connect with an external floppy disk drive or a printer. Since the cable connector is directly connected to a complimentary connector of the computer system, an EMI shielding effect must be considered in the design of the cable connector.

SUMMARY OF THE INVENTION

An objective of the present invention is to provide a cable connector having a better EMI shielding effect to ensure efficient signal transmission therethrough.

In order to achieve the objective set forth, a cable connector in accordance with the present invention generally comprises a housing defining a receiving chamber therein. The housing forms a mating portion for attaching to a mating connector and a rear portion through which a cable is directed. The cable is electrically connected with the connector by means of a printed circuit. An EMI bracket is arranged within the receiving chamber and a portion of the bracket extends beyond the mating portion of the housing.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
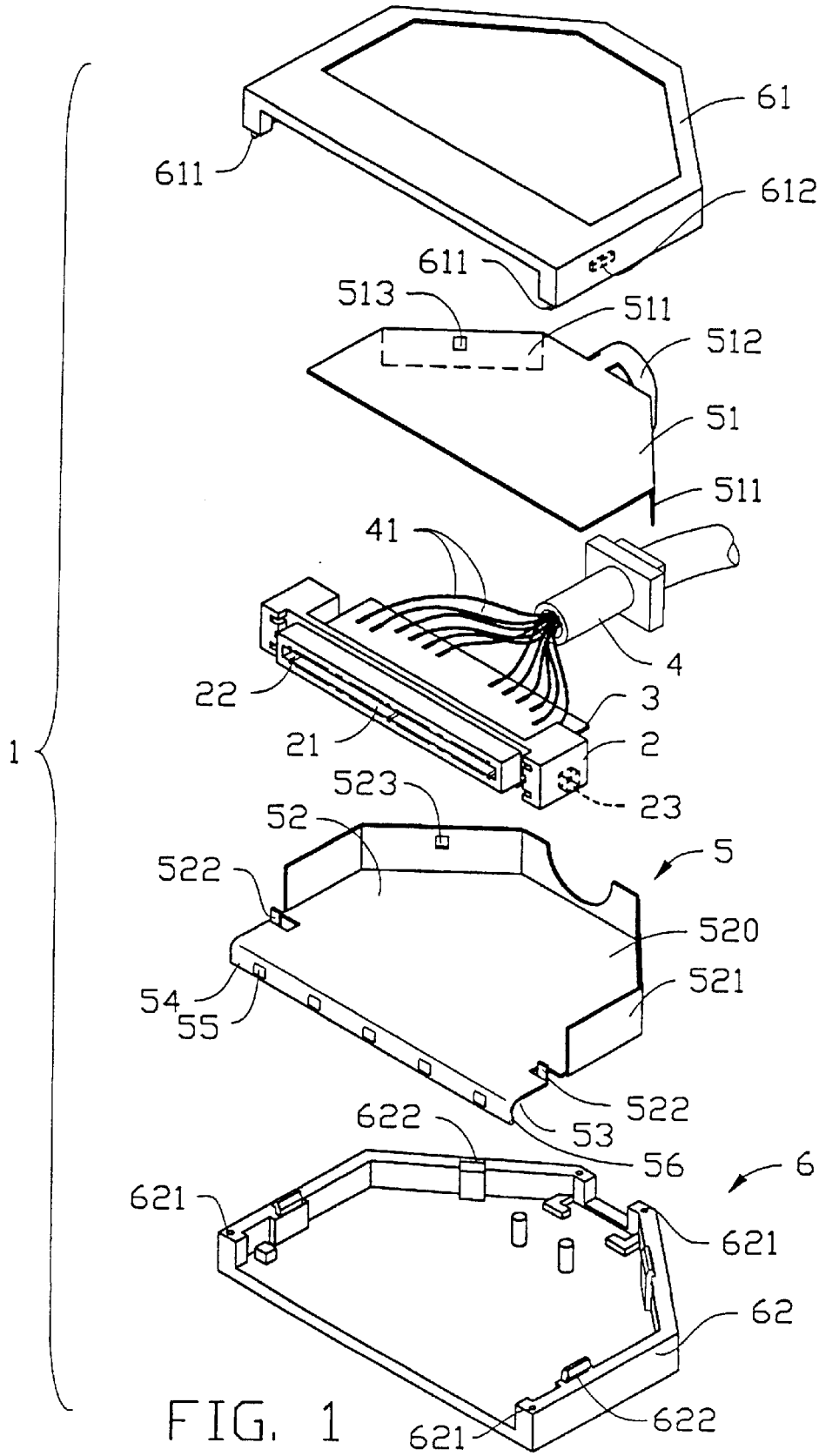
FIG. 1 is an exploded, perspective view of a cable connector in accordance with the present invention.
Figure 2:
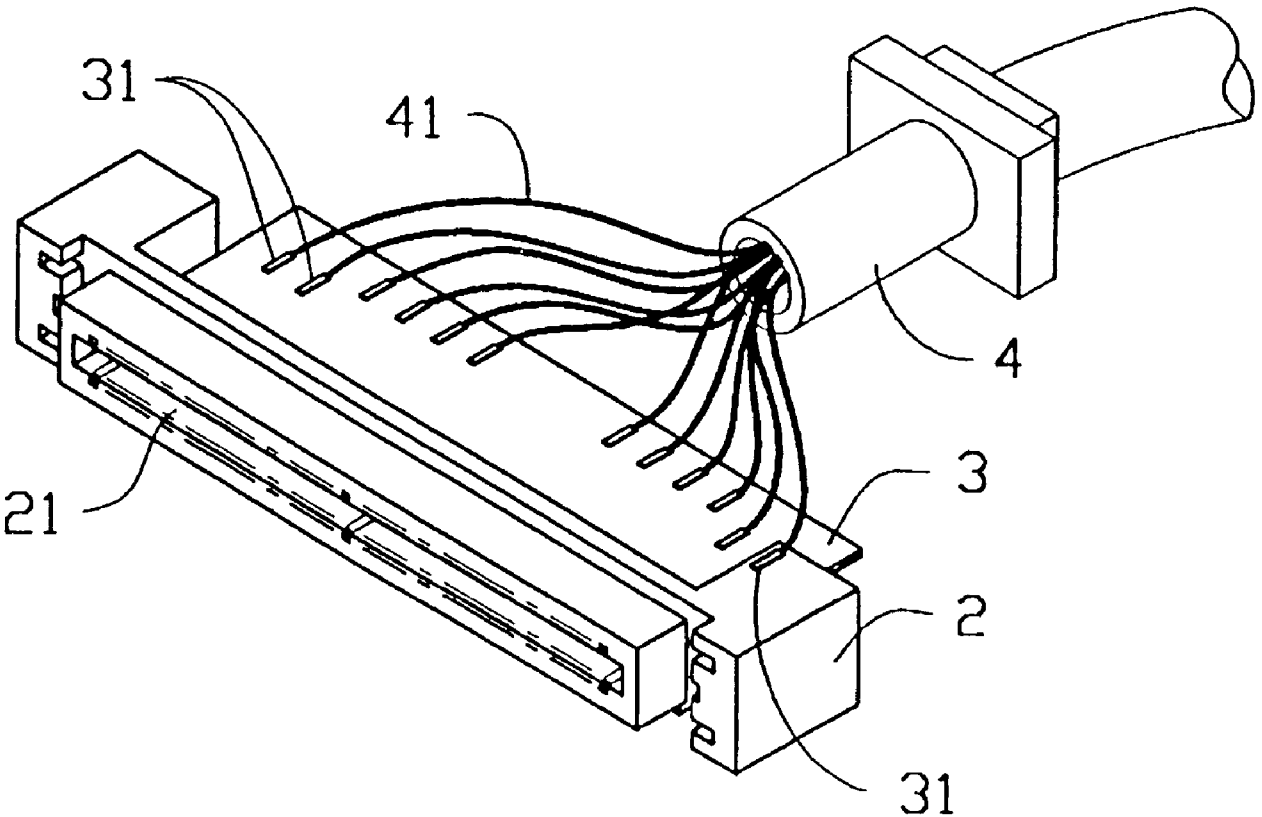
FIG. 2 is a partial, assembled view of the cable connector in which a housing and a EMI bracket are removed for clarity.
Figure 3:
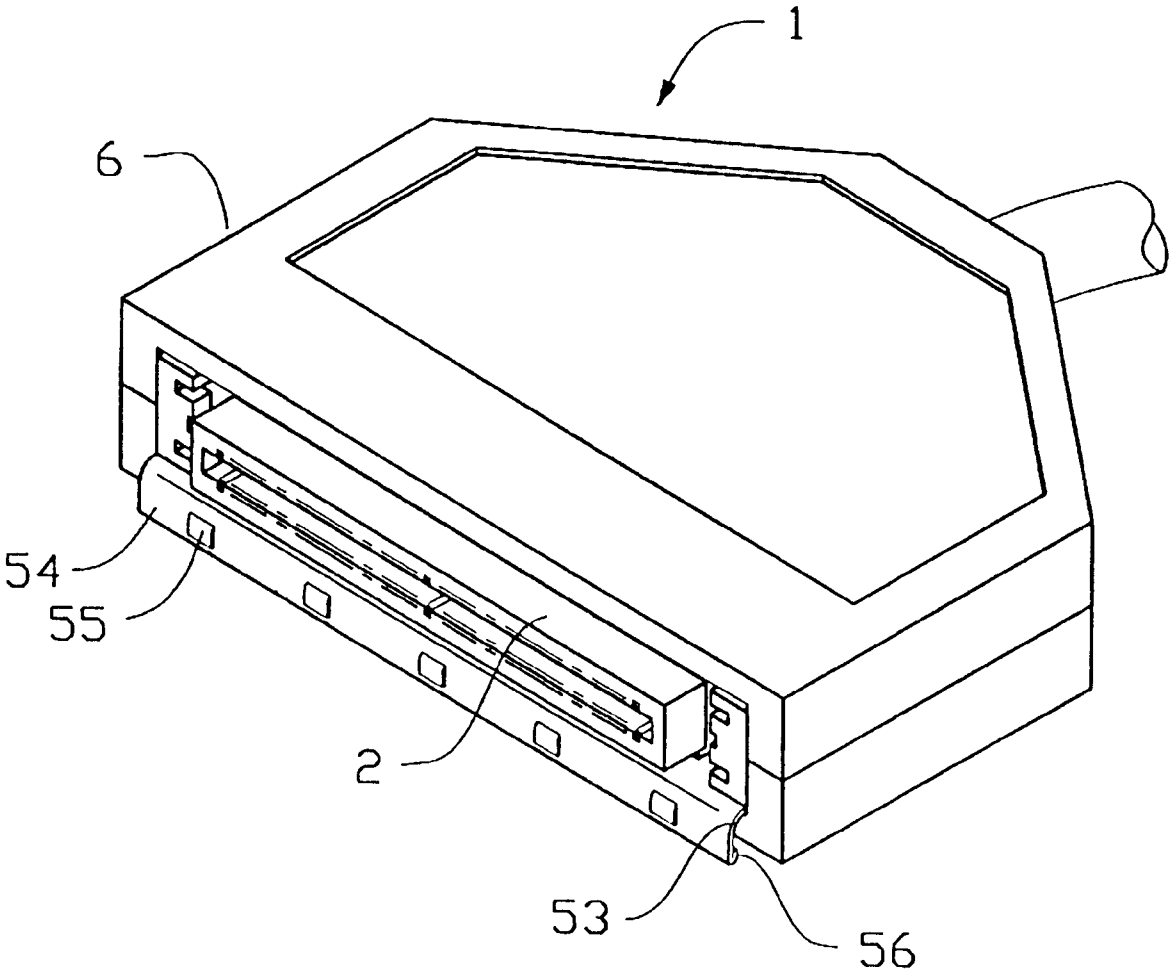
FIG. 3 is an assembled view of the cable connector of FIG. 1.

Referring to FIG. 1, a cable connector 1 in accordance with the present invention generally comprises an elongate insulative housing 2, a printed circuit board 3, a cable 4, an EMI shield 5, and an outer insulate shell 6. The housing 2 defines a receiving groove 21 in a front portion thereof. The receiving groove 21 defines a plurality of passageways 22 each receiving a terminal (not shown) therein. The housing 2 forms a connecting groove (not shown) for retaining the printed circuit board 3 therein. The printed circuit board 3 is electrically connected with the terminals. The housing 2 further defines a pair of retaining slots 23 in the bottom surface thereof. The cable 4 includes a plurality of conductors 41 each connecting with a corresponding trace 31 of the printed circuit board 3, as shown in FIG. 2.

The EMI shield 5 includes an upper half 51 and a lower half 52. The upper half 51 forms a pair of retaining tabs 511 each defining a retaining hole 513 therethrough. The shield 5 further includes a clip 512 located between the retaining tabs 511. The clip 512 is used to securely position the cable 4 during assembly. The lower half 52 forms a peripheral wall 521 extending along traverse sides thereof. The wall 521 is formed with a pair of projections 523 for engaging with the corresponding retaining holes 513 of the tabs 511. The lower half 52 further includes a pair of positioning tabs 522 for engaging with the corresponding retaining slots 23 of the housing 2.

The lower half 52 includes an extension 53 forming a mating face 54 orthogonal to a horizontal direction of the lower half 52. The mating face 54 forms a plurality of contacting buds 55. An edge (not labeled) of the mating face 54 is formed with a curved rim 56.

The outer shell 6 includes an upper shell 61 and a lower shell 62 for enclosing the above-described elements therein. The upper shell 62 is formed with a plurality of dowel pins 611 and retaining notches 612. The lower shell 61 is formed with a mounting hole 621 corresponding to each dowel pin 611, and a retaining wedge 622 for engaging with the corresponding retaining notch 612 of the upper shell 61.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims. Therefore, persons of ordinary skill in this field are to understand that all such equivalent structures are to be included within the scope of the following claims.

We claim:

1. A cable connector comprising:

an elongated insulative housing, said housing defining a mating portion with a front edge thereof in a front portion of said housing;

a plurality of terminals disposed in the housing;

an EMI metal shield including an upper half and a lower half coupled to each other and commonly enclosing the housing therein;

an outer insulative shell including an upper shell and a lower shell coupled to each other and commonly enclosing the EMI shield therein;

at least one of said upper half and said lower half of the EMI shield including an extension forwardly extending beyond a front edge of the insulative shell while behind the front edge of the mating portion of the housing; wherein said extension includes a mating face extending along a longitudinal direction of said mating portion of the housing with a plurality of contacting buds dispersed thereon, while also extending in a lateral direction with regard to a front-to-back direction of the connector; wherein said mating face is dimensioned to extend beyond said insulative shell in said lateral direction.

* * * * *